US007744064B2

(12) United States Patent
Orriere

(10) Patent No.: US 7,744,064 B2
(45) Date of Patent: Jun. 29, 2010

(54) COLLAPSIBLE BARRIER FOR SWIMMING POOL, PROVIDING A SAFE WALKING PATH

(76) Inventor: Gérard Orriere, 5, rue du Vieux Puits, F-77390 Courtemer (FR)

( * ) Notice: Subject to any disclaimer, the term of this patent is extended or adjusted under 35 U.S.C. 154(b) by 26 days.

(21) Appl. No.: 11/989,622

(22) PCT Filed: Dec. 7, 2005

(86) PCT No.: PCT/FR2005/003071

§ 371 (c)(1),
(2), (4) Date: Jan. 27, 2008

(87) PCT Pub. No.: WO2007/012706

PCT Pub. Date: Feb. 1, 2007

(65) Prior Publication Data

US 2009/0090898 A1 Apr. 9, 2009

(30) Foreign Application Priority Data

Jul. 27, 2005 (FR) ..... 05 08011

(51) Int. Cl.
*E06B 11/00* (2006.01)

(52) U.S. Cl. ..... 256/25; 256/1; 49/131; 49/340

(58) Field of Classification Search ..... 256/1, 256/25, 27; 49/131, 340; 404/6
See application file for complete search history.

(56) References Cited

U.S. PATENT DOCUMENTS

| | | | | |
|---|---|---|---|---|
| 3,094,710 | A * | 6/1963 | Hoke | 256/1 |
| 3,822,420 | A * | 7/1974 | Kindness | 4/500 |
| 5,248,215 | A * | 9/1993 | Fladung | 404/6 |
| 7,118,304 | B2 * | 10/2006 | Turpin et al. | 404/6 |

FOREIGN PATENT DOCUMENTS

| | | |
|---|---|---|
| FR | 2 809 432 | * 11/2001 |
| FR | 2 860 258 | * 4/2005 |

* cited by examiner

*Primary Examiner*—Michael P Ferguson
(74) *Attorney, Agent, or Firm*—Charles A. Muserlian

(57) ABSTRACT

A collapsible barrier to enclose a body of water, maneuverable between a deployed enclosure position and a collapsed position which barrier is comprised of panels articulated to each other, a ground panel (1) and an enclosure panel (2) which panels are formed from struts (4,7) supported by side rails (5,6), the struts (7) of the ground panel (1) together comprise a plate in which slits (3) are made through which the enclosure panel (2) struts, consisting of rods (4), can pass, so that in the deployed position of the barrier, the walkway surface provided by the ground panel (1) is nearly continuous.

7 Claims, 4 Drawing Sheets

COLLAPSIBLE BARRIER FOR SWIMMING POOL, PROVIDING A SAFE WALKING PATH

This application is a 371 of PCT/FR2005/003071 filed Dec. 7, 2005.

TECHNICAL DOMAIN OF THE INVENTION

The present invention is in the domain of safety devices for water expanses, specifically swimming pools, and more specifically the domain of enclosure barriers for a pool. Its object is a collapsible barrier, which can be maneuvered between a deployed position, in which the barrier fences the pool off, and a folded position, in which the barrier is collapsed to allow access to the pool.

STATE OF THE ART

For safety reasons, expanses of water, such as a swimming pool or similar, must be fenced in when they are not in use or when they are left without supervision. These provisions are intended specifically to prevent accidents by drowning, especially of children, by preventing access to the pool. It is therefore standard practice to provide expanses of water with enclosure barriers.

One problem presented lies in the unattractive appearance of these barriers, and in their bulk. Moreover, when the swimming pool is being supervised, their presence is rendered useless. This is why this type of barrier has been proposed. One could, for example, refer to documents WO2004007873 (RAT), U.S. Pat. No. 5,630,572 (GUAY) and FR2809432 (GENTILE) which describe barriers of this type.

Solutions typically proposed involve bare-brickwork projects as well as the laborious addition of accessories around the edges of the pool to house the retracted barrier, and perhaps even the devices used for moving it. Furthermore, this barriers of this type are still bulky, all the more because they are equipped with motorized devices for maneuvering them.

It will be noted that FR2809432 offers, more specifically, the use of the presence of the barrier to accentuate the edges of the pool, by giving it the additional function as poolside space, when the barrier is in at least a partially collapsed position. However, if this type of accentuation allows the barrier to be used in the collapsed position, its bulk is still significant and its installation on site involves the addition of accessories around the edges of the pool.

This is why a collapsible enclosure barrier is proposed in FR2860258 (ORRIERE) for a body of water, which consists of a pair of mutually articulated panels. One of these panels rests on the ground to form a footpath, whereas the other panel is designed to form the barrier when it is pulled out. These panels have a grid-like appearance, since they are made of slats, attached at a set distance apart from each other to side members. When the barrier is in the collapsed position, the slats of one of the panels fit between the slats of the other panel, forming poolside space around the pool. The barrier can be operated using motorized means, consisting of a hydraulic cylinder articulated at its ends to each of the panels. This cylinder is fitted in a mobile prop between a station that is inclined when the barrier is in the deployed position, and a position in which a section of the floor panel is stored when the barrier is in the collapsed position.

In practice, it has become apparent that if this type of barrier presented a solution to the problems and drawbacks indicated above, it would be worthwhile to consider improving it. In fact, the grid-like structure of these panels means that when the barrier is in the deployed position, the walking path formed by the ground panel does not provide sufficiently comfortable stability for the user, or even the option of a safe travel path. Moreover, the methods used for the motorized operation of the enclosure panel are still bulky, and are a source of interference for the user, especially with regard to ease of traffic flow around the pool when the barrier is in the erect position.

OBJECT OF THE INVENTION

The purpose of the present invention is to propose a collapsible enclosure barrier for a body of water, such as a swimming pool, that features a simple, low-bulk structure, and preferably can be operated by motorized means, and whose presence, when it is in the collapsed position, can be used to accentuate the boundaries of the pool. The barrier subject of this invention is intended to have a configuration that allows it to be quickly and easily installed on site, including installation on an existing site, without requiring modification to the edges of the pool.

BRIEF SUMMARY OF THE INVENTION

The present invention is, more specifically, intended to propose such a barrier of the type consisting of two panels articulated to each other, with one of the panels resting on the ground to make a walkway when the barrier is in the deployed position, and where both of the panels together comprise a poolside deck when the barrier is in the collapsed position. The present invention is particularly intended to propose a barrier of such a type that the walkway formed by the ground panel offers a comfortable, safe walking surface for the user. It also proposes this type of barrier whose accessory means of motorized operation are structurally simple, effective, reliable and durable, of limited bulk and which do not cause any interference for traffic around the pool no matter whether the barrier is in the open or collapsed position.

The barrier of the present invention is a collapsible barrier for enclosing an expanse of water, specifically that of a swimming pool. This barrier can be maneuvered between a deployed position, in which the barrier encloses the pool, and a folded position in which the barrier is collapsed to free up access to the pool. This barrier consists primarily of barrier elements comprising at least a pair of panels that are connected to each other by a hinge, and in which one of the enclosure panels is connected so that it pivots on a ground panel that is equipped with a means of anchoring it to the surface surrounding the pool. This ground panel forms a walkway path around the pool when the barrier is in the deployed position. Both of the panels consist primarily of side rails between which struts extend, with the struts of one of the panels being offset relative to the other panel such that when the barrier is in the collapsed position, the struts of one panel fit between the struts of the other panel to form a poolside deck.

According to the present invention, this type of barrier is primarily recognizable in that the struts of the ground panel together comprise a plate in which slits are made through which the enclosure panel struts, consisting of rods, can pass. These provisions are such that when the barrier is in the deployed position, the walkway surface provided by the ground panel is nearly continuous. The result is that the walkway offers a surface having only slits that cause no interference to the comfort and/or the safety of the user when he is moving along the walkway. Moreover, the quasi-continuous nature of the surface offered by the ground panel allows this panel to be used in and of itself as a deck when the barrier is in the collapsed position. More specifically, the enclosure panel's rods, which are rather narrow, can be completely embedded in the ground panel without compromising the option it offers to serve individually as a deck.

According to different variations of embodiment, the openings in the ground panel can be formed either by blind cavities and/or by through-slots.

Preferably, the plate is composed of slats affixed to struts that are close to each other. As an example, the separation distance between the slats is on an order of between 0.05 to 0.5 times their width.

The barrier is preferably equipped with a means of maneuvering the enclosure panel between the barrier's erect and collapsed positions. These means of maneuvering are, specifically, related to at least one motor unit. The means of maneuvering and the motor unit are advantageously placed under the plane of the ground panel. More specifically, the side rails of the ground panel are capable of forming a caisson marking the borders of a space inside of which the operating means and the motor unit are housed, especially as regards the barrier elements that form the edges of this latter. These provisions are such that neither the means used to operate the enclosure panel nor the motor unit associated with them constitute an obstruction for the free passage of traffic over the ground panel, whether the barrier is in the folded or deployed position.

More specifically, the enclosure panel is articulated to the ground panel around a pivot axis located at a distance from the base edge of the enclosure panel. The operating means consist of at least one connecting rod that is jointed around a tilt axis located between the said pivot axis and the base edge of the enclosure panel. This connecting rod is articulated to a first end of an operating arm, the second end of which is articulated to a shaft of the motor unit.

According to a first variation of embodiment, the motor unit is a hydraulic cylinder attached parallel to and beneath the general plane of the ground panel. It will be noted here that this cylinder can be attached to a caisson supporting the ground panel, or as part of the panel, or on the frame.

The operating arm is advantageously equipped with guide means parallel to the general plane of the ground panel. The result of these provisions is that no matter whether the barrier is in the deployed or collapsed position, the bulk of the operating means and of the motor unit is limited to a space contained substantially within a plane that is parallel to the plane of the ground panel, since these means are likely to be located inside a caisson supporting the ground panel.

Preferably, the hydraulic cylinder extends along the operating arm, said arm being articulated to one end to the cylinder rod. When the cylinder rod is in the retracted position, the barrier is in the collapsed position, whereas when cylinder rod is the extended position, the barrier is in the deployed position. These provisions allow the forces exerted by the cylinder to be best exploited for erecting the enclosure panel, during the operation of the barrier that requires the most power.

According to another variation of embodiment, the motor unit consists of an electric motor having at least one rotary shaft.

According to a specific form of embodiment intended to maneuver two adjacent panels that form an angle of the barrier, the motor unit comprises two rotary shafts that are orthogonal in relation to a respective operating arm. These operating arms are respectively used for operating two adjacent enclosure panels that are arranged orthogonally to each other to make a right angle of the barrier.

DETAILED DESCRIPTION OF THE INVENTION

The motor unit, specifically consisting of the electric motor with rotary shafts, is preferably housed inside a caisson made inside an open space made in the surface around the pool, preferably located at the ends of the edges of the barrier, on the outer side of said barrier relative to the pool.

It will be understood that the two variations of embodiment of the motorized means can be used as a complement to each other for operating the respective enclosure panels.

More specifically, the panels comprising the sides of the barrier can be operated by cylinders, specifically hydraulic cylinders, whereas the end panels of these sides can be operated by the electric motor unit with dual rotary shafts.

DESCRIPTION OF FIGURES

The present invention will be better understood, and the relevant details will become apparent, from the following description with reference to the figures in the attached drawings, in which:

In FIGS. 1 through 3, one element of the swimming pool barrier is primarily composed of two panels 1, 2 articulated to each other at one of their edges. This barrier is intended to be installed at the edge of a pool or similar. One of the panels forms a ground panel 1 intended to be anchored to the surrounding surface or paving bordering the pool, whereas the other panel is intended to form an enclosure panel 2. It is understood that the barrier of the invention consists of a plurality of sets of such panels 1, 2, which form the modular elements of the barrier and which abut each other to form its sides.

Figure 1:
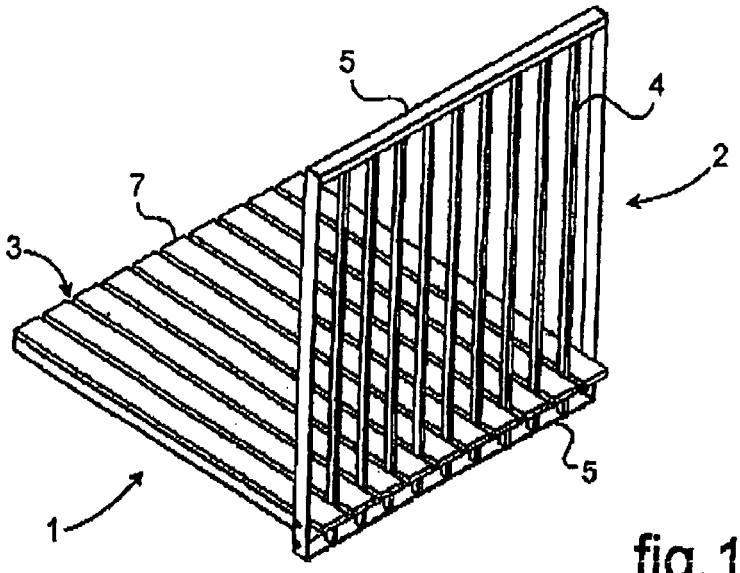
FIGS. 1 through 3 are perspective diagrams of one element of one barrier of the present invention, respectively in the deployed, intermediate and collapsed position.
Figure 2:
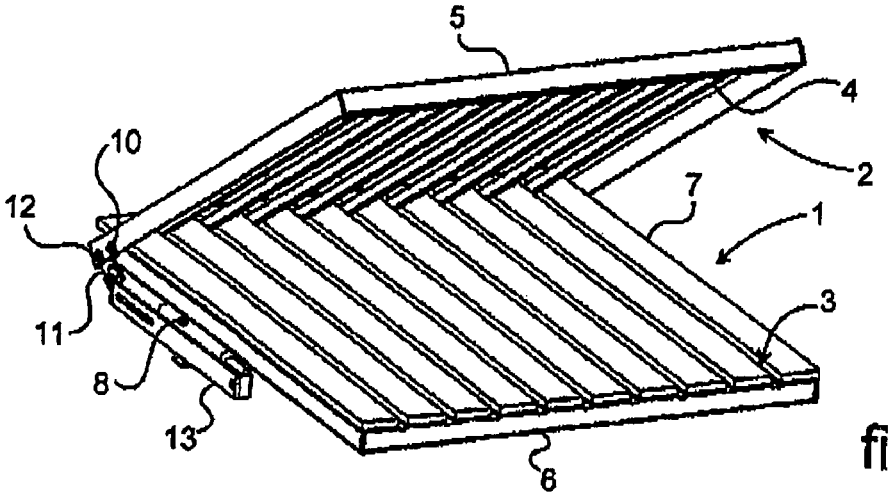
Figure 3:
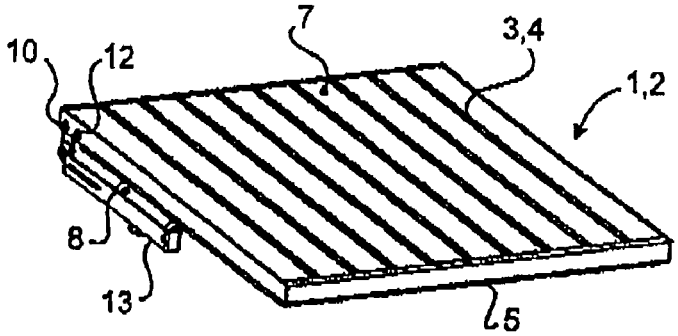

This barrier element can be maneuvered between a deployed position, in which the enclosure panel 2 is erect as shown in FIG. 1, and a collapsed position in which the enclosure panel 2 is folded down towards the ground panel 1 to collapse it, as shown in FIG. 3. The ground panel 1 forms a walkway, or even a poolside deck whether the barrier is in the erect or collapsed position.

Figures 4, 5, 6, 7:
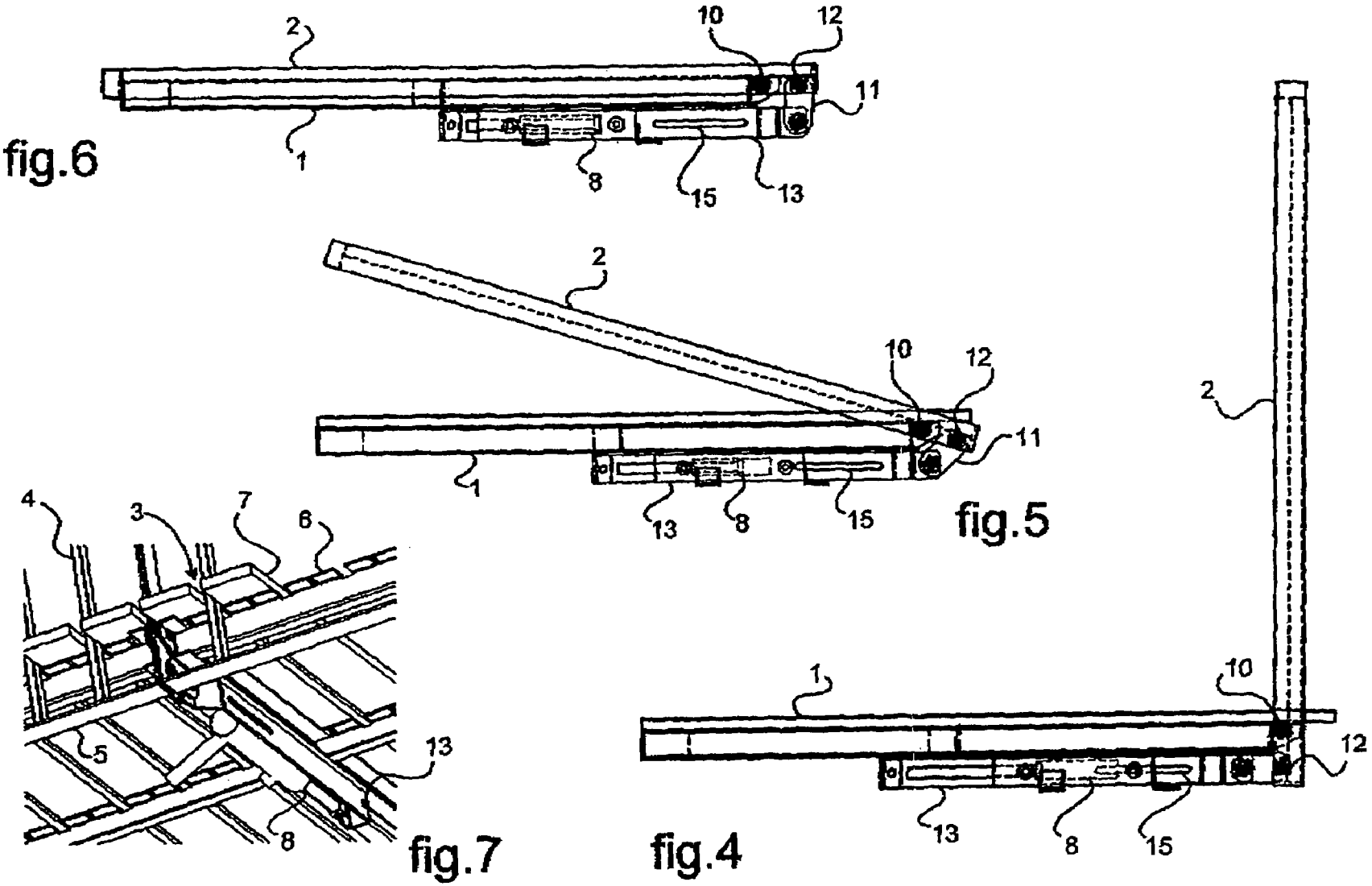
FIGS. 4 through 6 are side view diagrams of one element of the motorized barrier of the present invention, according to a first variation of embodiment, respectively in the deployed, intermediate and collapsed position.
FIG. 7 is a partial perspective bottom view of one element of the barrier shown in FIGS. 4 through 6, in the deployed position.

The ground panel 1 forms a plate consisting of spaces 3 intended to receive bars 4 which comprise the enclosure panel 2, when the barrier is in its folded position. In FIG. 7, it will be noted that panels 1, 2 are primarily composed of side rails 5, 6 having struts. The struts of the ground panel 1 are formed from slats 7 attached to the side rails 6 close to each other, so that a space 3 is provided that is just enough to accept the struts in enclosure panel 2, formed by rods 4. For example, the ground panel 1 is formed from slats 7, of wood or rigid plastic material, whereas the enclosure panel 2 is of metal or carbon fiber reinforced resin for example.

In FIGS. 4 through 13, the barrier is equipped with a means of operating the enclosure panel 2, in relation to a motor unit 8 or 9. The enclosure panel 2 is articulated to the ground panel 1 around a pivoting axle 10 provided near the base edge of enclosure panel 2. A connecting rod 11 is articulated at one of its ends in the vicinity of the base edge of enclosure panel 2, around a pivot shaft 10 and the base edge of enclosure panel 2. The connecting rod 11 is articulated at its other end to one end of an operating arm 13 or 14, whose other end is articulated to the motor unit 8 or 9.

According to the variation of embodiment illustrated in FIGS. 4 through 7, the motor unit is a hydraulic cylinder 8. This motorization variation is rather advantageous for operating an enclosure panel 2 of a barrier element used to form one side thereof. It will be noted that optionally, a clearance associating the operating means 11, 13 and the motor unit 8 is installed at each of the ends of the enclosure panel 2. The hydraulic cylinder 8 is oriented parallel to and extends along the operating arm 13. The head of cylinder rod 8 is articulated to the second end of operating arm 13, which is opposite the end of said operating arm by means of which it is articulated to connecting rod 11. The operating arm 13 comprises a guide means 15 for its movement in translation, where this means consists, in the example of embodiment in the illustration, of pins mounted on the ground panel 1 and which travel along elongated holes made in the operating arm 13. Operating the enclosure panel 2 when the barrier is in the deployed position is done by extending the rod of cylinder 8. The operating arm 13 is, for example, produced using a member that is folded at its ends to form wings onto which are articulated, respectively, the heads of cylinder rod 8 and of connecting rod 11.

Figure 8:
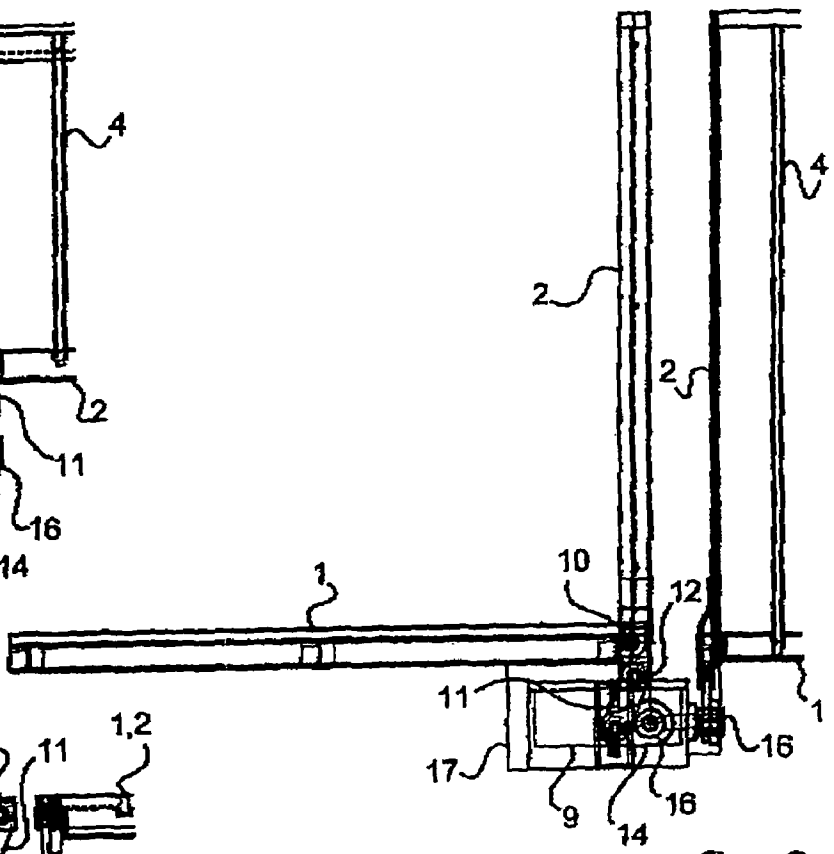
FIGS. 8 though 10 are side view diagrams of one element of the motorized barrier of the present invention, according to a second variation of embodiment, respectively in the deployed, intermediate and collapsed position.
Figure 9:
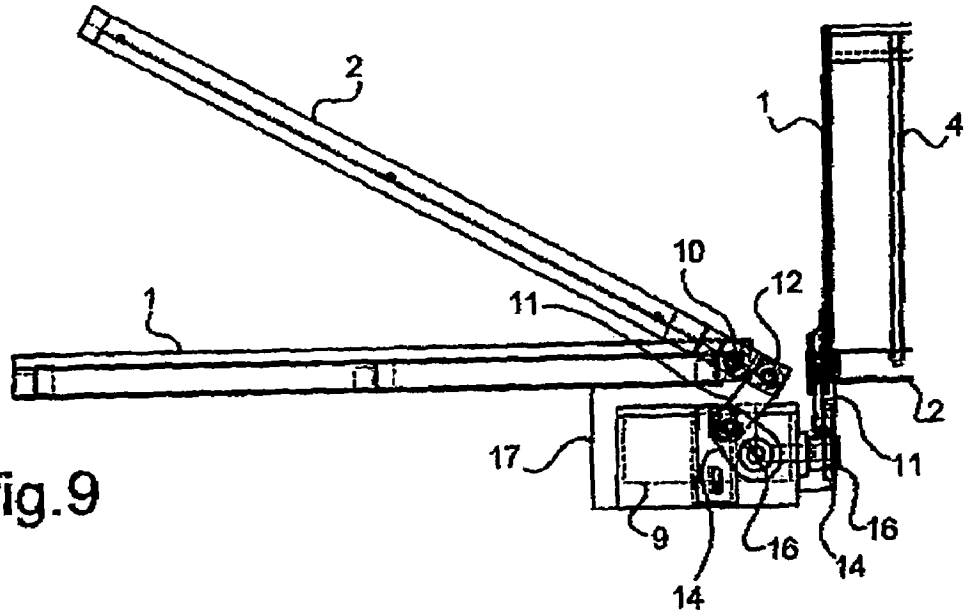
Figure 10:
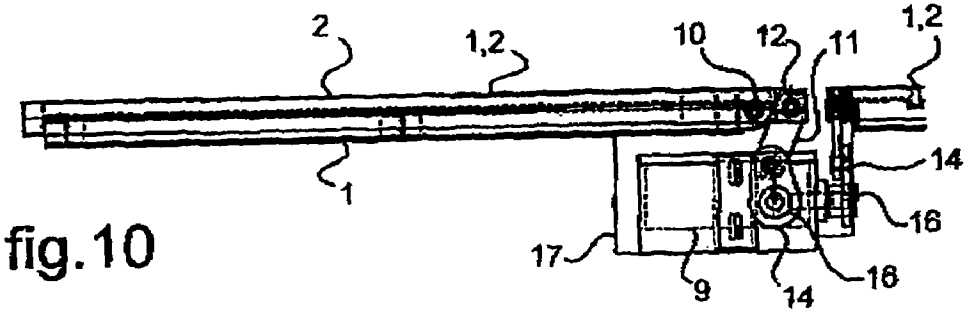
Figure 11:
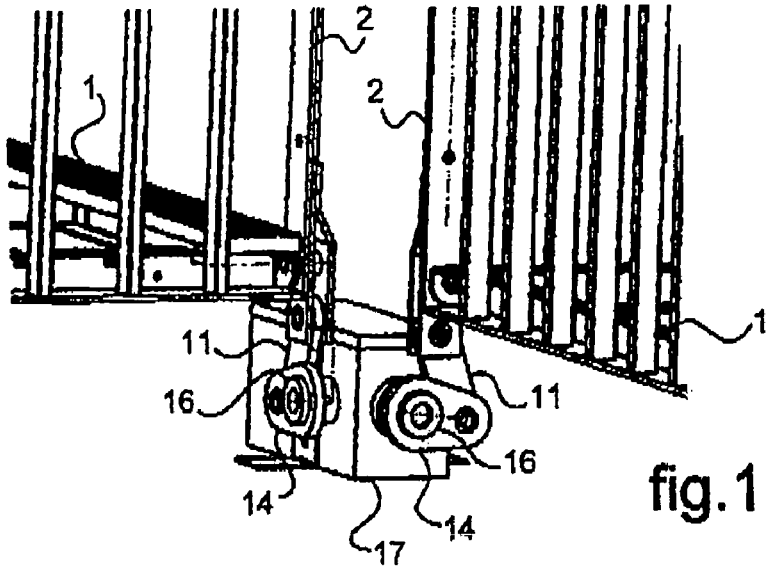
FIGS. 11 through 13 are perspective illustrations of the motorization means equipping two barrier elements of the type represented in FIGS. 8 through 10, which are oriented to each other so that together they form an angle of the barrier, respectively in the deployed, intermediate and collapsed positions.
Figure 12:
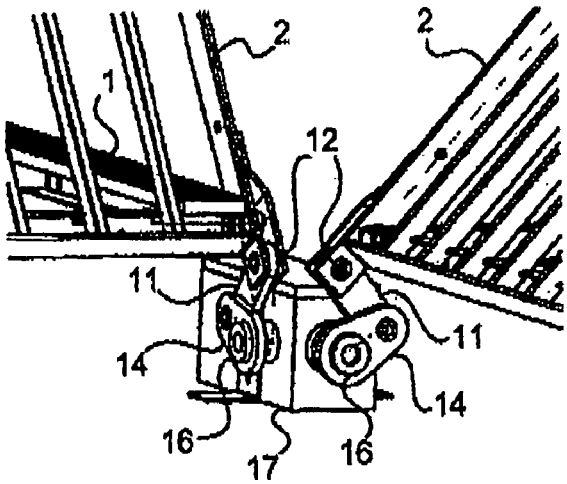
Figure 13:
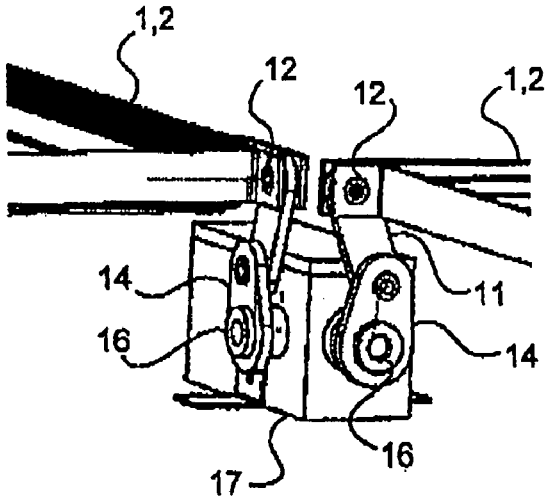

According to the variation of embodiment illustrated in FIGS. 8 though 13, the motor unit is an electric motor 9. This motorization variation is rather advantageous for operating a pair of barrier elements arranged orthogonally to each other, to form an angle of the barrier as shown in the figures. This motor unit 9 comprises a pair of rotary shafts 16 which operate a respective enclosure panel 2. The operating arms 14 are each formed from a plate or similar, articulated at their ends, respectively, to connecting rod 11 and around a rotary shaft 16 of the motor unit 9, to drive them in rotation. The motor unit 9 is powered using a low-voltage power, and is housed inside a watertight caisson 17 provided so that it is housed inside an opening in the surface surrounding the pool.

It will be noted that the provisions proposed are such that, no matter what the variation of embodiment used for operating means 11, 13, 14 and the motor unit 8, 9, these latter are disposed beneath the general plane of ground panel 1, so that they create no obstruction relative to the traffic around the pool.

The invention claimed is:

1. A collapsible barrier enclosing a swimming pool, the barrier being maneuverable between a deployed position in which the barrier encloses the pool, and a folded position in which the barrier is collapsed to free up access to the pool, the barrier comprising at least one barrier element each barrier element comprising:

a pair of panels pivotally articulated relative to each other between the deployed position and the folded position, comprising an enclosure panel pivotally connected to a ground panel that is equipped with a means of anchoring the ground panel to a ground surface surrounding the pool, both of the enclosure and ground panels consisting of a pair of side rails between which a plurality of parallel struts extend;

wherein the enclosure panel is articulated relative to the ground panel about a pivot axis parallel to the side rails of the panels and located at a distance from a base edge of the enclosure panel;

wherein the ground panel forms a plate comprising slits formed between adjacent struts of the ground panel through which the struts of the enclosure panel can pass, the struts of one of the panels being offset relative to the struts of the other panel, such that when the barrier is in the folded position, the struts of one panel fit between the struts of the other panel to form a planar poolside deck, and such that when the barrier is in the deployed position, the ground panel forms a nearly continuous walkway surface around the pool;

wherein each battier element is equipped with a means of operating the enclosure panel between the deployed and folded positions, each operating means comprising;

a motor unit comprising an electric motor having at least one rotary shaft rotating about the pivot axis:

a connecting rod fixedly connected to the base edge of the enclosure panel; and an operating arm comprising a first end pivotally connected to the connecting rod about a tilt axis, the connecting rod being articulated around the tilt axis relative to the operating arm, and comprising a second end connected to and articulated by a respective rotary shaft the tilt axis being located between the pivot axis and the base edge of the enclosure panel, the operating means being placed beneath a plane of the ground panel;

wherein rotation of the operating arm via the rotary shaft about the pivot axis pivots the connecting rod and the enclosure panel about the tilt axis between the deployed and folded positions.

2. A collapsible barrier of claim 1, wherein the slits in the ground panel form blind cavities.

3. A collapsible barrier of claim 1, wherein the slits in the ground panel form though-slots.

4. A collapsible barrier of claim 1, wherein the plate is composed of slats attached close to each other on side rails.

5. A collapsible barrier of claim 1, wherein the motor unit comprises two rotary shafts that are each orthogonal in relation to a respective operating arm, said operating anus being respectively used for operating two adjacent enclosure panels that are arranged orthogonally to each other to make a right angle of the baffler.

6. A collapsible barrier of claim 5, wherein the motor unit is housed inside a caisson disposed in an opening of a frame.

7. A collapsible barrier of claim 1, wherein the motor unit is housed inside a caisson disposed beneath the ground panel.

* * * * *